US008047463B2

(12) United States Patent
Ruggenenti

(10) Patent No.: US 8,047,463 B2
(45) Date of Patent: Nov. 1, 2011

(54) WIRE WINDING SPOOL

(75) Inventor: Luca Ruggenenti, Remedello (IT)

(73) Assignee: Velaworks S.R.O., Pribenik (SK)

( * ) Notice: Subject to any disclaimer, the term of this patent is extended or adjusted under 35 U.S.C. 154(b) by 0 days.

(21) Appl. No.: 12/595,578

(22) PCT Filed: Apr. 15, 2008

(86) PCT No.: PCT/EP2008/054538

§ 371 (c)(1),
(2), (4) Date: Oct. 12, 2009

(87) PCT Pub. No.: WO2008/128925

PCT Pub. Date: Oct. 30, 2008

(65) Prior Publication Data

US 2010/0140387 A1 Jun. 10, 2010

(30) Foreign Application Priority Data

Apr. 20, 2007 (IT) ..... MN2007A0017

(51) Int. Cl.
*B65H 75/14* (2006.01)

(52) U.S. Cl. ..... 242/608; 242/608.7; 242/614

(58) Field of Classification Search ..... 242/608, 242/608.7–608.8, 609.4, 614
See application file for complete search history.

(56) References Cited

U.S. PATENT DOCUMENTS

| | | | | |
|---|---|---|---|---|
| 1,528,985 | A | 3/1925 | Odquist | |
| 1,598,912 | A | 9/1926 | Hoopes | |
| 1,672,167 | A | 6/1928 | Mossberg | |
| 298,378 | A | 10/1928 | Saulter | |
| 1,699,700 | A * | 1/1929 | Kjellstrom | 242/608 |
| 1,892,356 | A | 12/1932 | Mills | |
| 1,920,420 | A | 8/1933 | Mills | |
| 1,920,422 | A | 8/1933 | Mills | |
| 2,514,932 | A * | 7/1950 | Denny et al. | 242/608.8 |
| 2,521,922 | A * | 9/1950 | Kurtz | 242/614.1 |
| 2,662,701 | A | 12/1953 | Weber | |
| 4,066,225 | A * | 1/1978 | Bauer | 242/118.8 |
| 5,106,031 | A * | 4/1992 | Sanda et al. | 242/118.4 |
| 6,289,570 | B1 | 9/2001 | Peterson | |
| 6,959,892 | B2 * | 11/2005 | Sanda | 242/608.8 |
| 7,222,818 | B2 * | 5/2007 | Couchey et al. | 242/614 |
| 2003/0071611 | A1 * | 4/2003 | Sanda | 324/158.1 |

FOREIGN PATENT DOCUMENTS

AU 27409 84 A 11/1984

* cited by examiner

*Primary Examiner* — Sang Kim
(74) *Attorney, Agent, or Firm* — Greer, Burns & Crain, Ltd.

(57) ABSTRACT

A wire winding spool, comprising a tubular body for supporting a coil of wire provided, at its ends, with wall elements for containing the coil, at least one of the wall elements being provided with at least one pin for engaging means for turning the spool, each wall element being associated with the corresponding end of the tubular body so as to rest against an abutment provided on the outer surface of the wall of the body, clamped against it by a fold of the end portion of the wall.

9 Claims, 8 Drawing Sheets

WIRE WINDING SPOOL

TECHNICAL FIELD

The present invention relates to a wire winding spool.

BACKGROUND ART

It is known that spools for winding wire which comprise a tubular body for supporting the coil of wire, provided at its ends with wall elements for containing the coil, are widely used in the industrial field.

Known spools have a certain constructive complexity, which derives in particular from assemblies obtained by welding.

DISCLOSURE OF THE INVENTION

Therefore the aim of the present invention is to provide a spool which has maximum simplicity.

This aim is achieved by a wire winding spool, according to the invention, comprising a tubular body for supporting a coil of wire provided, at its ends, with wall elements for containing said coil, at least one of the wall elements being provided, at the surface directed outwardly, with at least one pin for engaging means for turning said spool, characterized in that each wall element is associated with the corresponding end of the tubular body so as to rest against an abutment provided on the outer surface of the wall of said body, clamped against it by a fold of the end portion of said wall.

BRIEF DESCRIPTION OF THE DRAWINGS

Further characteristics and advantages of the present invention will become better apparent from the description of some preferred but not exclusive embodiments thereof, illustrated by way of non-limiting example in the accompanying drawings, wherein.

WAYS OF CARRYING OUT THE INVENTION

Figure 1:
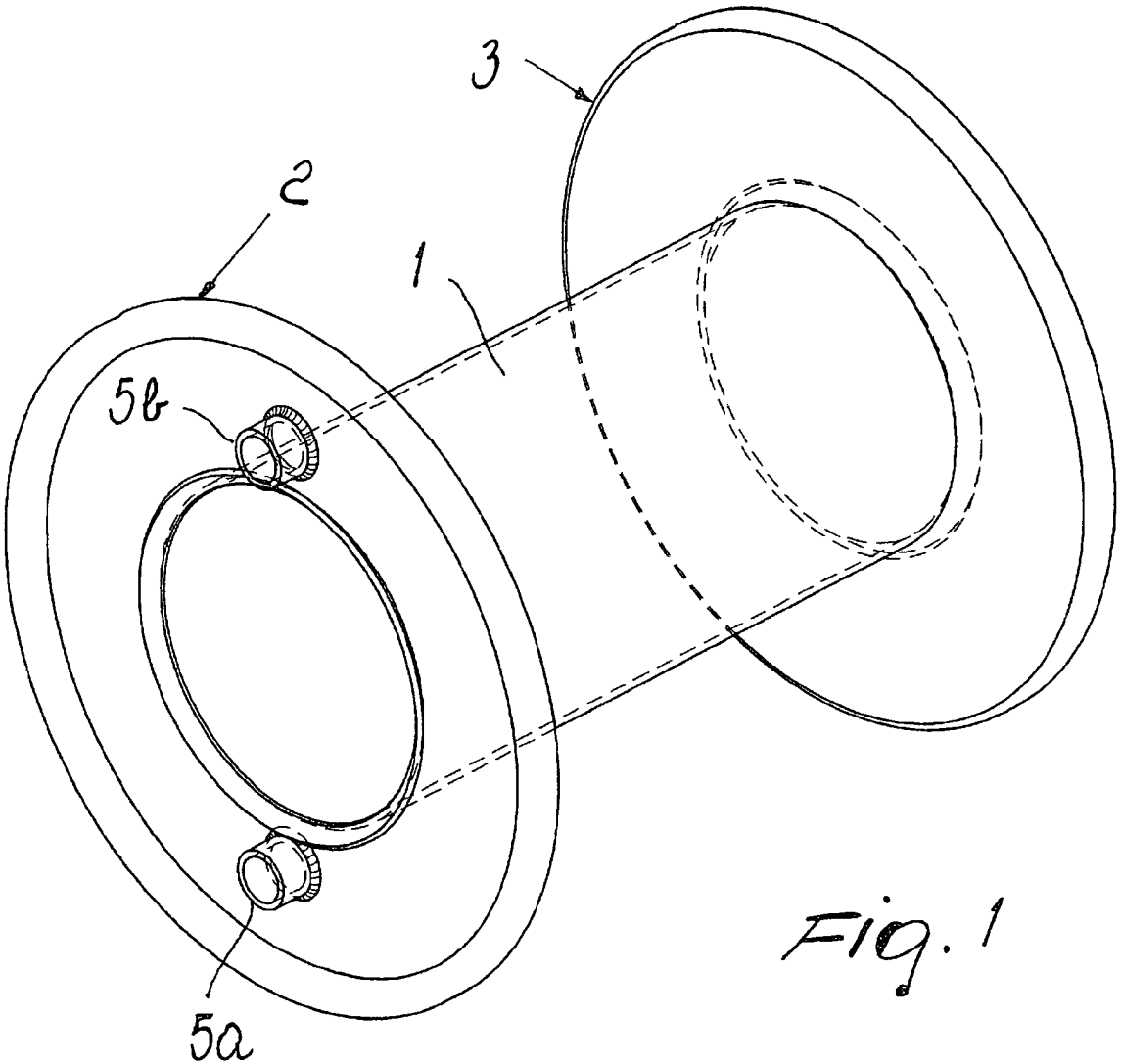
FIG. 1 is a perspective view of the spool according to the invention.
Figure 2:
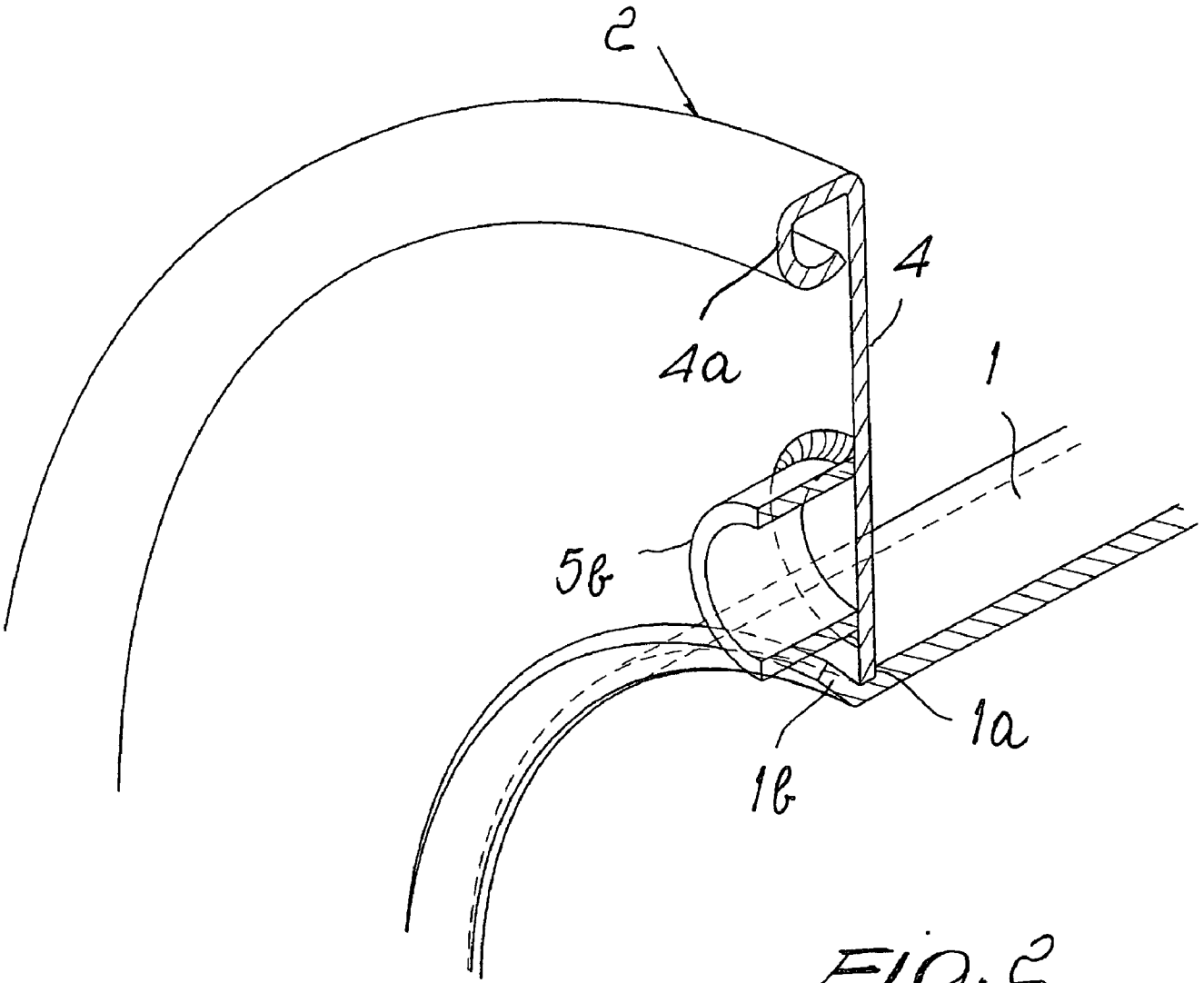
FIG. 2 is a view of a detail of FIG. 1.

With reference to FIGS. 1 and 2, the reference numeral 1 designates a tubular body for supporting a coil of wire, which is provided at the ends with two wall elements 2 and 3, which are mirror-symmetrically identical.

Therefore, only the element 2 is described; it is formed by a flat flange 4 with a stiffening fold 4*a* at the outer edge and welded driving pins 5*a*, 5*b*; as regards such pins, it should be considered that they might be absent in the element 3.

The flange 4 is associated with the end of the tubular body 1 so as to rest against an abutment 1*a* provided on the outer surface of the wall of the body, clamped against it by a fold 1*b* of the end portion of the wall, which is obtained very easily by plastic deformation of the material.

It should be noted that the fold 1*b*, besides performing the function indicated above, acts as an effective guide for the penetration of the spindle designed to support the spool during operation.

Figure 3:
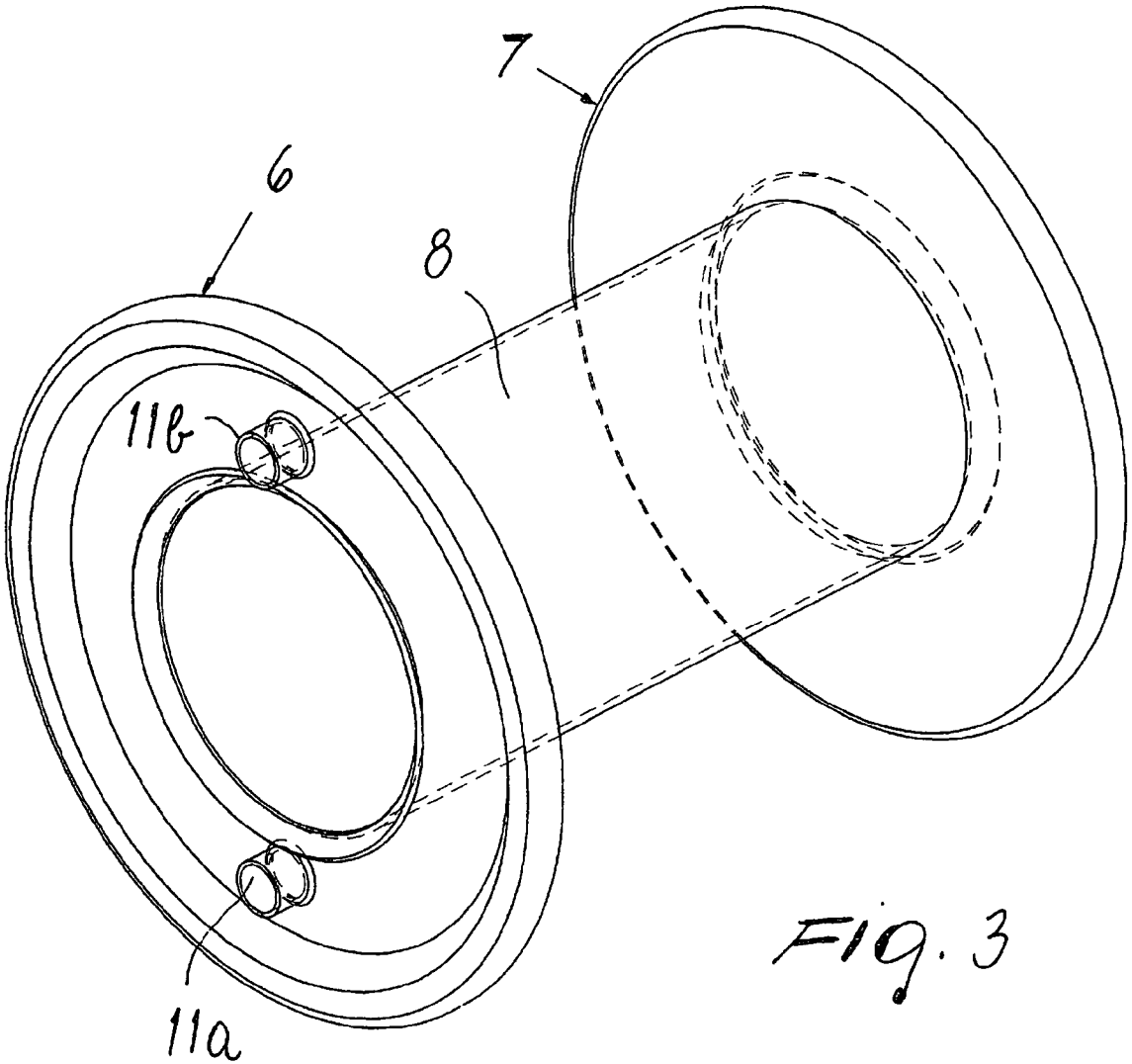
FIG. 3 is a perspective view of a first variation of the spool according to the invention.
Figure 4:
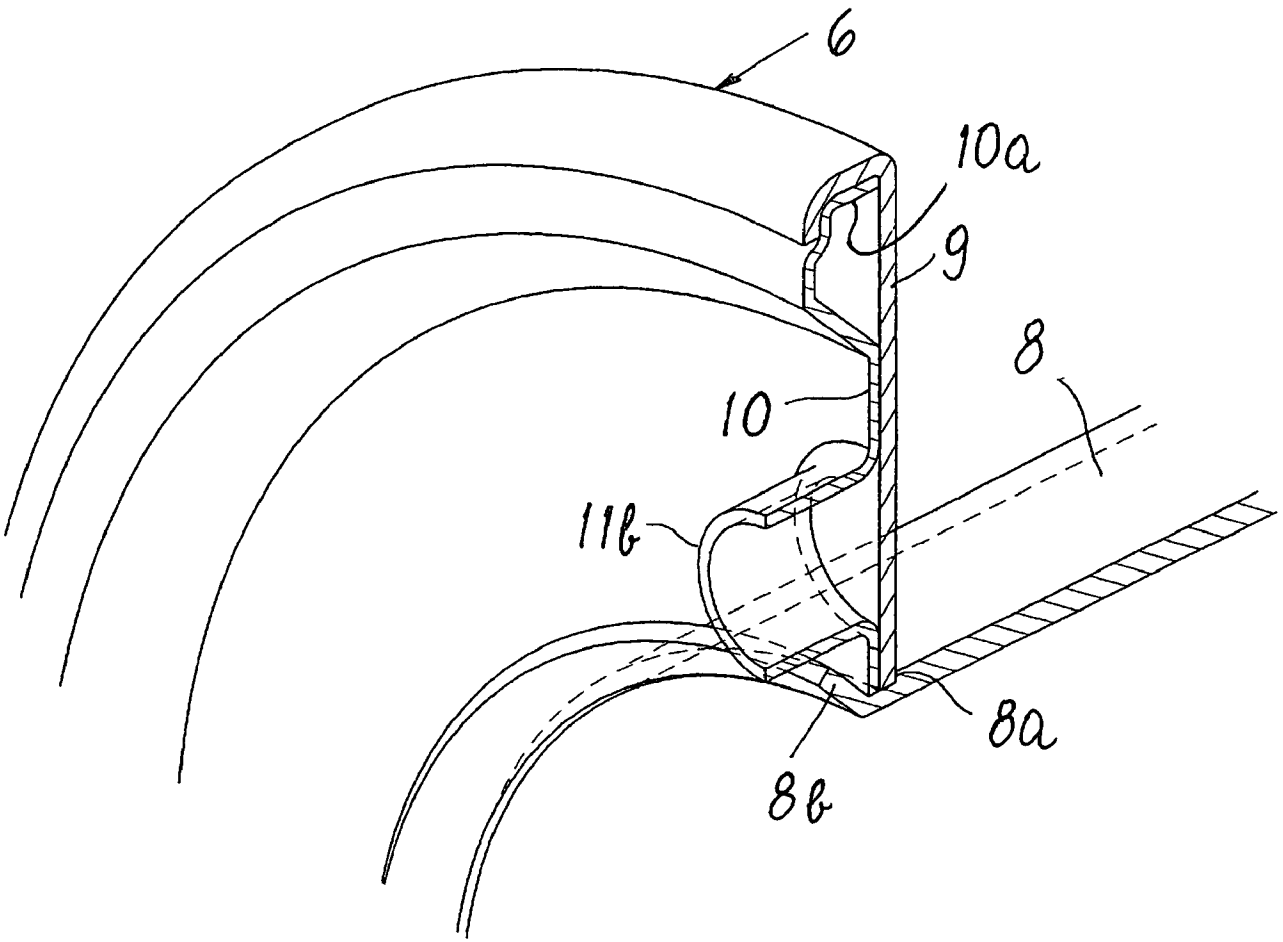
FIG. 4 is a view of a detail of FIG. 3.
Figure 5:
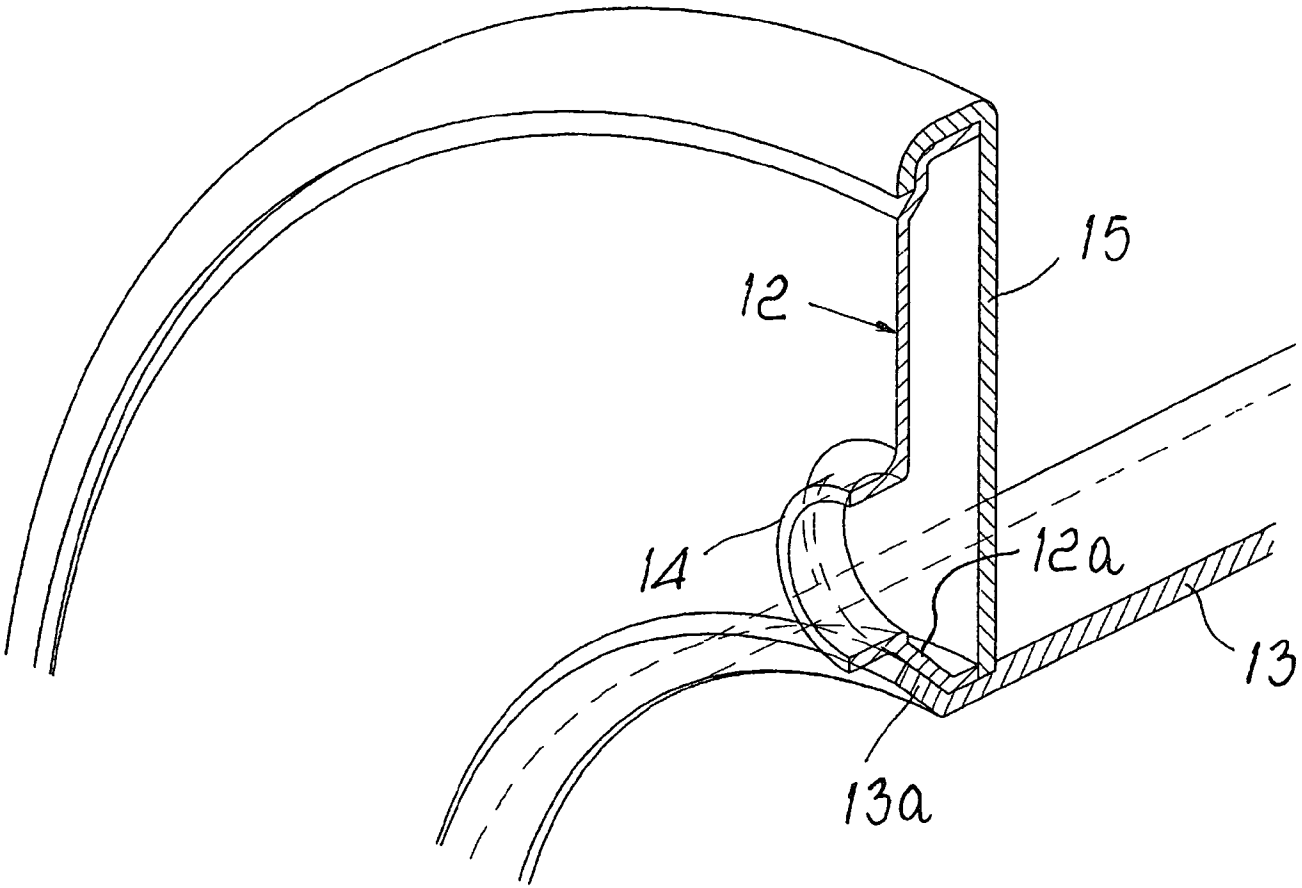
FIGS. 5 to 8 are views of details of the spool shown in FIG. 4 related to further variations.

A first variation of the invention is shown in FIGS. 3 and 4, and in such variation the wall elements 6 and 7 arranged at the ends of the tubular body 8 have mirror-symmetrically identical shapes, which are now described with reference to the element 6.

Such element comprises a flat flange 9 and a complementary flat flange 10 which adheres thereto and is joined by seaming to the flange 9 at an outer edge 10*a*, and is provided with pins 11*a*, 11*b* which are formed monolithically and which might be absent in the element 7.

In this case also, the element 6 is associated with the end of the body 8 so as to rest against an abutment 8*a* and be clamped against it by a fold 8*b*.

The complementary flanges provided so as to form, by being joined by seaming at the corresponding outer edge to corresponding flat flanges, the wall elements of the variations of FIGS. 5 to 8, all have a camber at the inner edge, so as to come into contact with the fold of the end portion of the wall of the tubular body which, in all of such variations, clamps the wall elements against corresponding abutments.

More particularly, a complementary flange 12 (see FIG. 5) has a camber which, from an inner edge 12*a* in contact with a fold 13*a* of the wall of a tubular body 13, extends along the entire extension of the complementary flange, with pins 14 which are formed monolithically, so as to be spaced from a corresponding flange 15.

Figure 6:
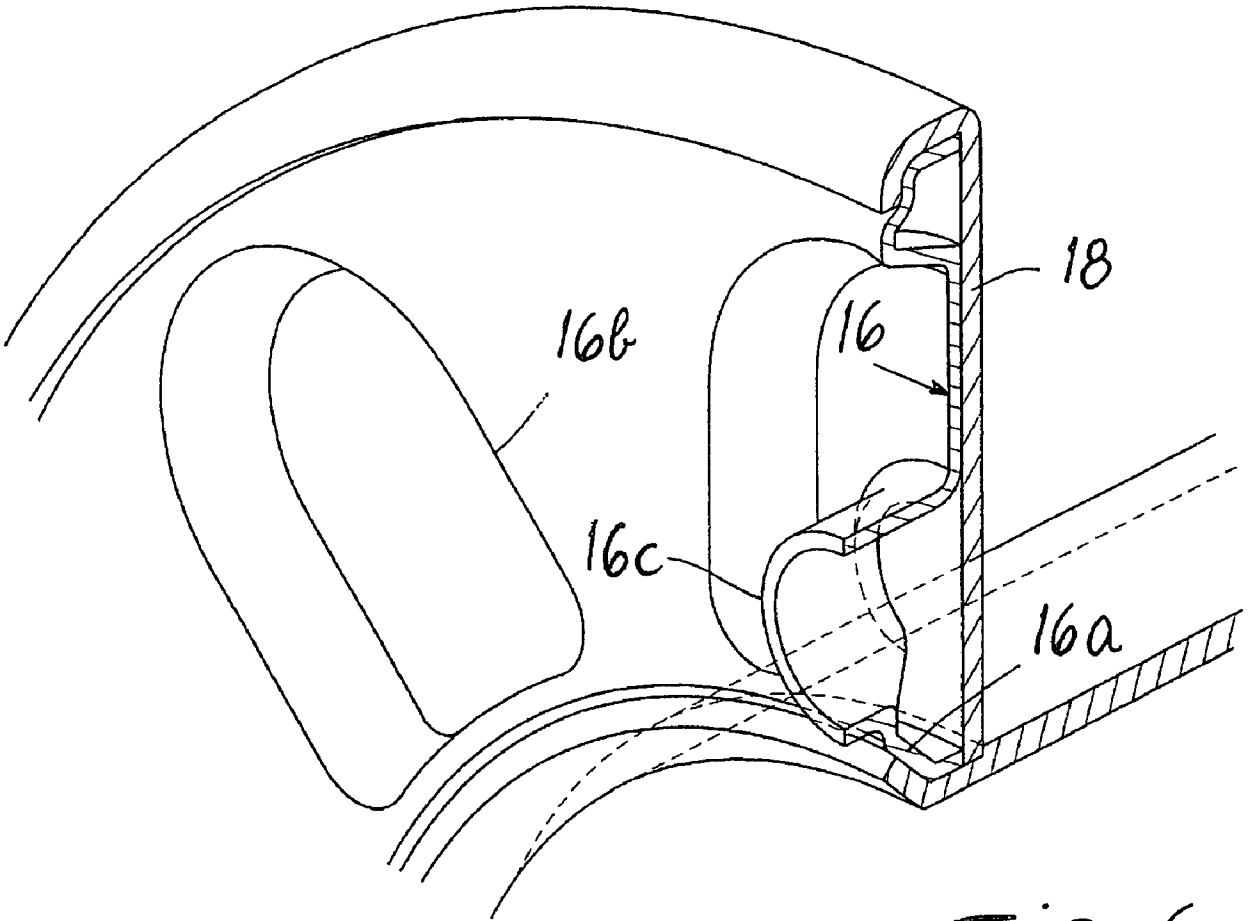
Figure 7:
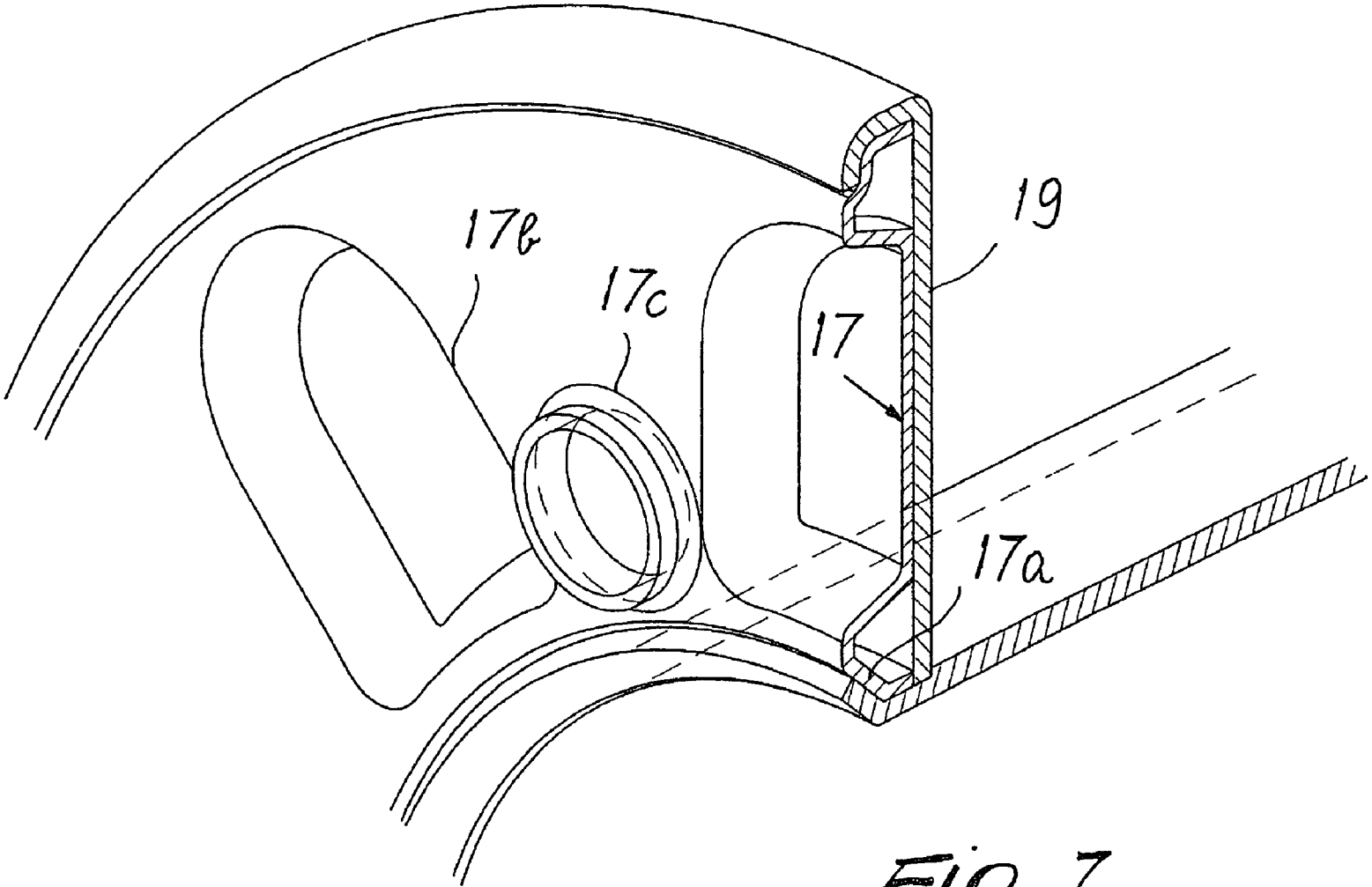
Figure 8:
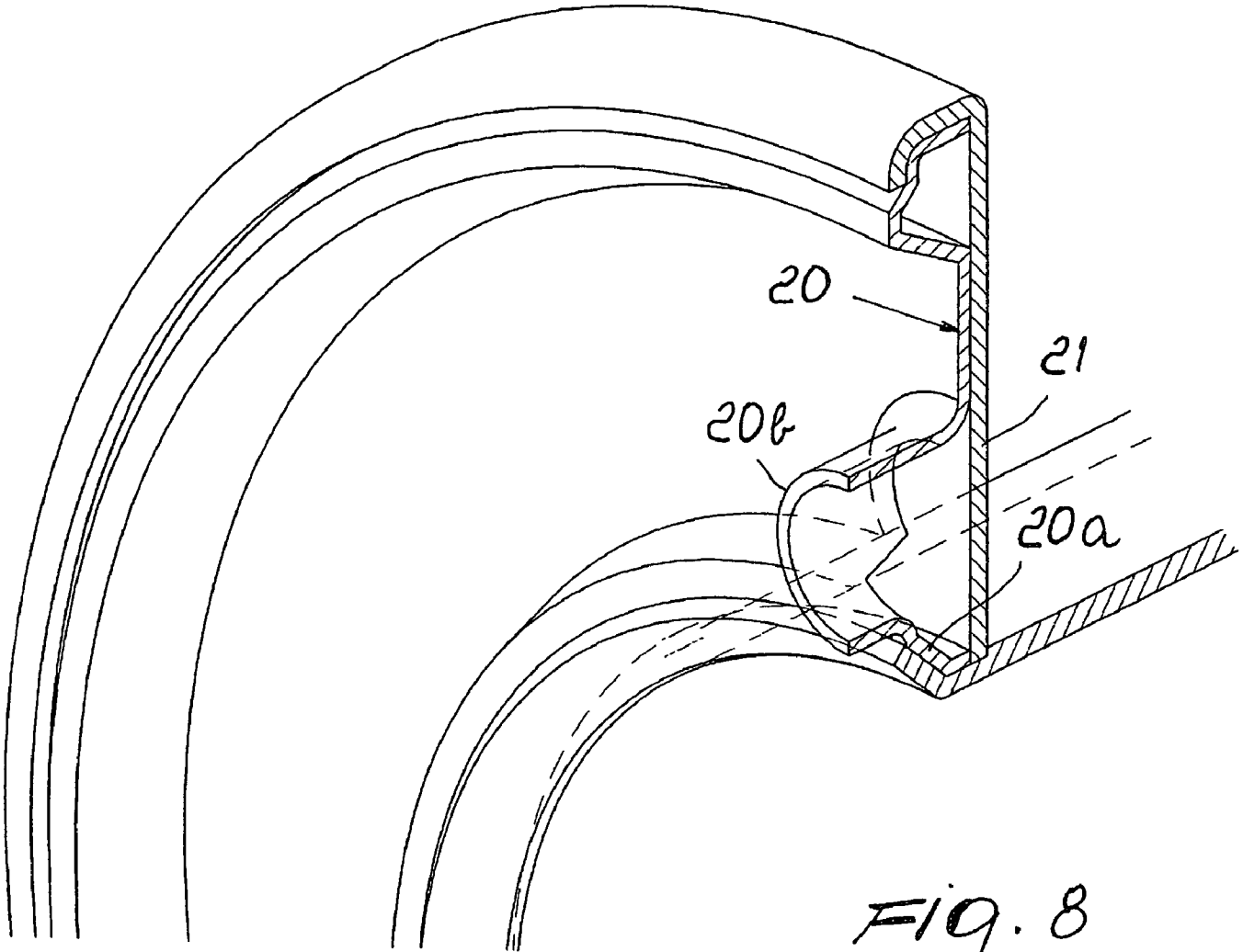

Complementary flanges 16 and 17 of FIGS. 6 and 7 also have cambers which, by extending from inner edges 16*a*, 17*a*, cover their entire extension, and there are also studs 16*b*, 17*b* which are deep so as to come into contact with contiguous flanges, respectively 18 and 19; the complementary flange 16 has pins 16*c* which are formed at the studs, while the complementary flange 17 has pins 17*c* which are formed in gaps between the studs.

Finally, a complementary flange 20 (see FIG. 8) has a camber 20*a* only at the inner edge, while the rest adheres to a corresponding flange 21; there are also pins 20*b* which are formed monolithically.

The described invention is susceptible of numerous other modifications and variations, all of which are within the scope of the appended claims; all the details may further be replaced with other technically equivalent elements.

The disclosures in Italian Patent Application no. MN2007A000017, from which this application claims priority, are incorporated herein by reference.

The invention claimed is:

1. A wire winding spool, comprising:

a tubular body having a wall for supporting thereon a coil of wire;

wall elements for containing said coil, said wall elements provided one at each one of the opposite end portions of said tubular body and being constituted by a flat flange and by a complementary flange, the complementary flange being joined to an outer surface of said flat flange;

at least one driving pin that is provided at a surface directed outwardly of at least one of said wall elements, said driving pin being suitable to be engaged by engaging means for turning said spool;

an abutment provided on an outer surface of the wall of said tubular body;

a fold provided at each one of the opposite end portions of said tubular body, the fold constituted by a flaring out bevel of the respective said end portion;

a camber provided at least at an inner edge of each said complementary flange and shaped so as to come into contact with the fold of the respective end portion of the wall of the tubular body, each wall element being associated with the corresponding end portion of the tubular body so as to rest with said flat flange against said abutment and clamped thereagainst by said camber into contact with said fold of the respective end portion of said wall.

2. The spool according to claim 1, wherein each wall element comprises a flat flange and a complementary flange which is joined by seaming to the outer surface of the flange at the outer edge.

3. The spool according to claim 2, wherein the complementary flange has a flat shape which is adapted to adhere to the contiguous flange.

4. The spool according to claim 2, wherein the complementary flange has a camber which extends along the entire extension thereof.

5. The spool according to claim 2, wherein the complementary flange has a camber which extends along the entire extension thereof and has deep studs, pins being provided which are formed monolithically at the bottom of the studs.

6. The spool according to claim 2, wherein the complementary flange has a camber which extends along the entire extension thereof and has deep studs, pins being provided which are formed monolithically at gaps between the studs.

7. The spool according to claim 2, wherein the complementary flange has a camber only at the inner edge.

8. The spool according to claim 1, wherein at least one wall element provides for the presence of at least one pin which is rigidly coupled to said element.

9. The spool according to claim 1, wherein at least one wall element has at least one pin obtained monolithically from said element.

* * * * *